US006230590B1

(12) United States Patent
Guse

(10) Patent No.: US 6,230,590 B1
(45) Date of Patent: May 15, 2001

(54) REMOTELY OPERATED RAISE DRILL TORQUE TOOL

(75) Inventor: Daniel William Robert Guse, Ontario (CA)

(73) Assignee: Mining Technologies International Inc., Sudbury (CA)

( * ) Notice: Subject to any disclaimer, the term of this patent is extended or adjusted under 35 U.S.C. 154(b) by 0 days.

(21) Appl. No.: 09/433,554

(22) Filed: Nov. 4, 1999

(30) Foreign Application Priority Data

Nov. 6, 1998 (CA) ..... 2253068

(51) Int. Cl.[7] ..... B25B 17/00
(52) U.S. Cl. ..... 81/57.41; 175/52; 173/189
(58) Field of Search ..... 81/57.33, 57.41, 81/57.39; 175/52; 173/189

(56) References Cited

U.S. PATENT DOCUMENTS

| | | | | |
|---|---|---|---|---|
| 4,117,894 | * | 10/1978 | Saunders | 173/23 |
| 5,653,297 | * | 8/1997 | Whisenhunt | 175/52 |
| 5,778,742 | * | 7/1998 | Stuart | 81/57.34 |
| 5,791,206 | * | 8/1998 | Daigle et al. | 81/57.33 |
| 6,012,360 | * | 1/2000 | Concha | 81/57.39 |

FOREIGN PATENT DOCUMENTS

| | | |
|---|---|---|
| 910895 | 9/1972 | (CA) . |
| 927374 | 5/1973 | (CA) . |
| 929510 | 7/1973 | (CA) . |
| 988502 | 5/1976 | (CA) . |
| 1004215 | 1/1977 | (CA) . |
| 1009225 | 4/1977 | (CA) . |
| 1112683 | 11/1981 | (CA) . |
| 2156560 | 8/1995 | (CA) . |

* cited by examiner

*Primary Examiner*—Joseph J. Hail, III
*Assistant Examiner*—David B. Thomas
(74) *Attorney, Agent, or Firm*—Finnegan, Henderson, Farabow, Garrett & Dunner

(57) ABSTRACT

An apparatus for making and breaking a threaded connection between a drill head and a stabilizer mounted on an end of a drill string includes a wrench capable of operatively engaging a portion of the drill head so as to substantially prevent rotation of the drill head with respect to the wrench. A gripper assembly is operatively mounted on the wrench. The gripper assembly is capable of operatively receiving a portion of the stabilizer, and releasably locking the stabilizer against rotation relative to the gripper assembly. Finally, at least one drive unit is operatively coupled between the gripper assembly and the wrench for driving rotational movement of the gripper assembly with respect to the wrench.

18 Claims, 6 Drawing Sheets

REMOTELY OPERATED RAISE DRILL TORQUE TOOL

BACKGROUND OF THE INVENTION

1. Field of the Invention

This invention relates to a remotely operated tool for making and breaking the threaded connection between a drill head and a stabilizer mounted on the end of a drill string.

2. Description of the Related Art

Raise boring is a method of underground rock drilling used in the mining industry. This method involves drilling a pilot hole from one level of a mine to a lower level, removing the pilot bit, attaching a larger diameter raise boring head to the drill string and pulling it back through the previously drilled pilot hole. Finally, the raise boring head is lowered back down to the lower level, where the raise boring head is removed from the drill string.

Typically, the drill string is composed of a plurality of pipe sections which are secured to each other by threaded connections. The drill string typically terminates at a stabilizer unit, to which is connected the pilot bit during the first phase of the operation, and the raise boring head during subsequent phases of the raise boring operation. The threaded connections within the drill string are designed to transmit the "working torque" load between the drilling rig on the upper mine level and the pilot drill or raise boring head. However, the connections must be preloaded at a torque up to approximately 20% greater than the working torque. All of the connections within the drill string are preloaded by the drilling rig, except for the connection between the stabilizer and the raise boring head.

Detaching the pilot drilling head, and attaching and detaching the raise boring head involves the use of torque tools to "break" and "make" the rotary shouldered threaded connections between the respective heads and the stabilizer. These torque tools are also used to generate the necessary pre-loading torque. Various torque tools have been developed for this purpose. See, for example, Canadian Patents Nos. 910,895; 927,374; 929,510; 988,502; 1,004,215; 1,009,225; 1,112,683; and Canadian Patent Application No. 2,156,560 (published May 19, 1996). These references describe respective systems for making and breaking the joint between pipe sections of a drill string, and are also usable for making and breaking the joint between the drill head and the stabilizer unit at the end of the drill string.

However, as demonstrated by the systems taught by the above references, known torque tools require that at least a portion of the mechanism surrounds the drill string. Thus in each case, the torque tools must be installed around the drill string prior to use. Problems which exist with this installation are generally safety issues. Primarily, the torque tool equipment is heavy and working conditions often make it awkward and unsafe for men to work. Once the raise boring operation is complete, the raise boring head must be detached from the drill string, and this typically requires that workers must stand on the raise boring head to attach the torque tools, thereby exposing the men to the dangers associated with working under the open hole. In order to alleviate these problems, additional equipment can be installed to protect the men from falling rock. However, these measures are expensive and time consuming.

An object of the present invention is to provide a method and apparatus for making and breaking the threaded connection between a drill head and a stabilizer mounted on the end of a drill string, which overcomes the above-noted deficiencies of the prior art.

Another object of the invention is to provide a method and apparatus for making and breaking the threaded connection between a drill head and a stabilizer mounted on the end of a drill string, such that the need for men to work under an open hole is substantially eliminated.

SUMMARY OF THE INVENTION

Accordingly, an aspect of the present invention provides an apparatus for making and breaking a threaded connection between a drill head and a stabilizer mounted on an end of a drill string. The apparatus comprises a wrench capable of operatively engaging a portion of the drill head so as to substantially prevent rotation of the drill head with respect to the wrench. A gripper assembly is operatively mounted on the wrench. The gripper assembly is capable of operatively receiving a portion of the stabilizer, and releasably locking the stabilizer against rotation relative to the gripper assembly. Finally, at least one drive unit is operatively coupled between the gripper assembly and the wrench for driving rotational movement of the gripper assembly with respect to the wrench.

In an embodiment of the invention, the gripper assembly comprises a generally C-shaped housing defining an gripper mouth for receiving the stabilizer; and at least one gripper operatively mounted within the housing for releasably engaging a rib of the stabilizer.

In an embodiment of the invention, the gripper comprises a shoe mounted for substantially radial movement with respect to a longitudinal axis of a stabilizer disposed within the gripper mouth, and extension means for forcibly moving the shoe inwardly and outwardly to respectively lock and unlock the stabilizer against rotation relative to the gripper assembly.

In an embodiment of the invention, the extension means is any one of an hydraulic ram and a pneumatic ram.

In an embodiment of the invention, there are 4 grippers substantially evenly separated for each other within the housing of the gripper assembly, the grippers acting cooperatively to releasably lock and unlock the stabilizer against rotation relative to the gripper assembly.

In an embodiment of the invention, the wrench comprises a generally C-shaped body defining a wrench opening capable of operatively receiving a portion of the drill head, the wrench opening being substantially co-extensive with the mouth of the gripper housing when the apparatus is view from above.

Preferably, the wrench opening is sized to receive and operatively engage opposed wrench-flats of the drill head, whereby rotation of the drill head with respect to the wrench is substantially prevented. In an embodiment of the invention, a back wall of the wrench opening is provided such that, when drill head is slid into the wrench opening and a wrench flat of the drill head contacts the back wall, then the central axis of the drill string will be substantially coextensive with a centroid of the wrench opening.

In an embodiment of the invention, the wrench comprises a pair of opposed guide faces oriented so as to automatically guide a drill string into the mouth of the gripper assembly and wrench opening as the assembly is moved toward the drill string.

In an embodiment of the invention, the drive unit comprises at least one hydraulic ram operatively coupled to the wrench and the gripper assembly, such that rotation of the wrench can be effected by extension and/or retraction of the hydraulic ram. Alternatively, the drive unit can comprise at least one pneumatic ram operatively coupled to the wrench and the gripper assembly, such that rotation of the wrench can be effected by extension and/or retraction of the pneumatic ram.

In an embodiment of the invention, the apparatus is operatively mounted on the end of an arm, such that the apparatus can be remotely maneuvered into position around the drill head and stabilizer.

BRIEF DESCRIPTION OF THE DRAWINGS

Further features and advantages of the present invention will become apparent from the following detailed description, taken in combination with the appended drawings, in which.

DESCRIPTION OF THE PREFERRED EMBODIMENTS

Figure 1:
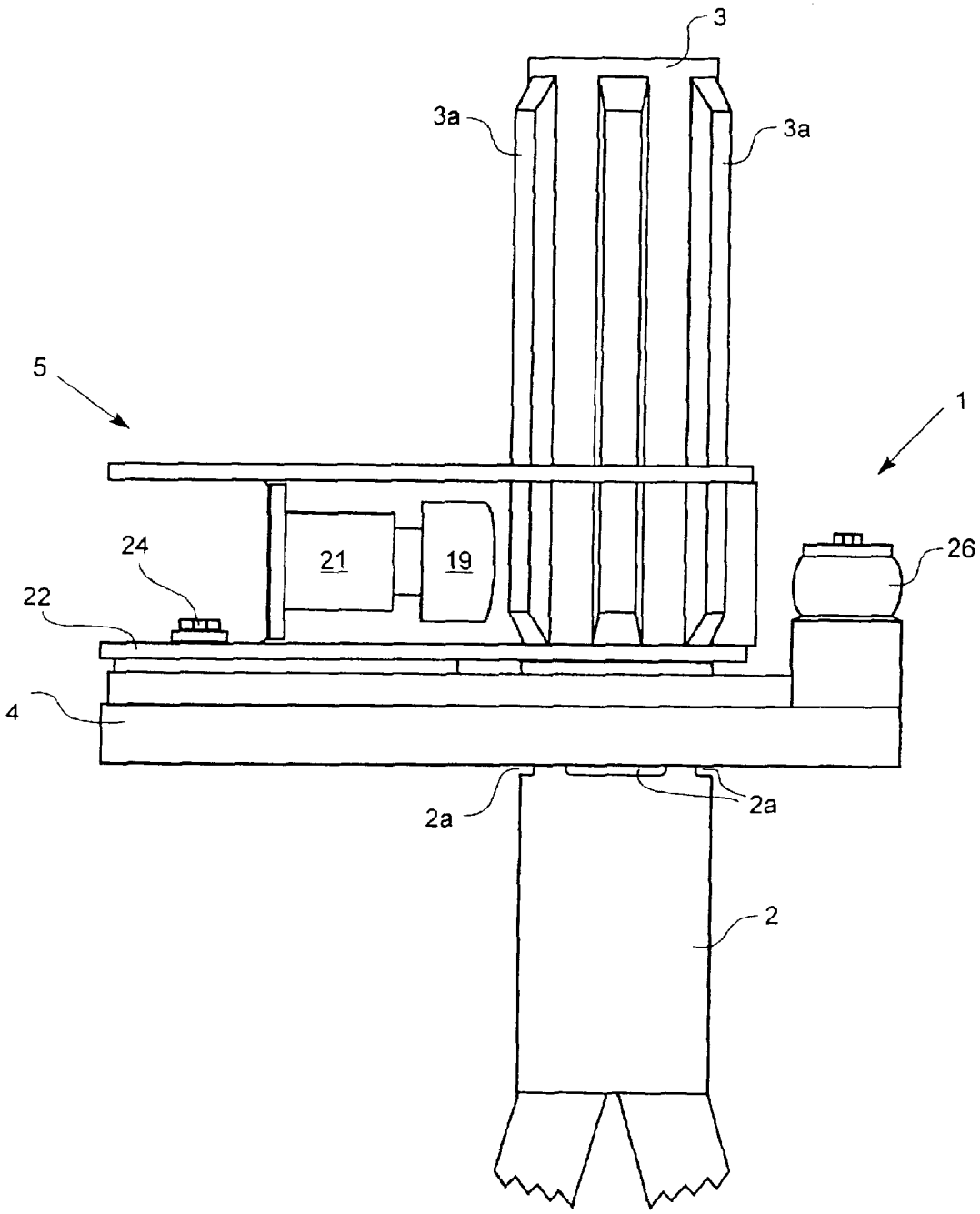
FIG. 1 is a side view of a torque tool in accordance with an embodiment of the present invention.

The present invention is of particular use when drilling between levels in a mine. In this case, a conventional drilling rig is set up at a desired location (for example in a drift) on one level of the mine, and is used in a conventional manner to drill a pilot hole through to a drift located on a lower level of the mine. Conventionally, the drill string comprises a number of pipe sections which are joined by threaded connections, and terminates at a drill bit, which is also joined to the drill string by means of a threaded connection. In raise boring operations, a stabilizer is also employed as the first section of the drill string in order to stabilize the raise boring head. In this case, the drill bit for the pilot hole is attached to the stabilizer at the beginning of the drilling operation. Once the drill bit emerges into the lower level drift, the drilling bit is removed from the stabilizer, and replaced by a raise boring head, which is subsequently pulled back through the pilot hole by the drilling rig. As a result of the high working torque loads generated during drilling operations, the threaded connection between the drill bit and the stabilizer is typically very tight. Thus extremely high forces are required in order to "break" the connection, and thus allow separation of the drilling bit from the drill string.

Thus according to the present invention, a torque tool 1 provides an apparatus for remotely making and breaking a threaded connection between a drill head 2 and a stabilizer 3. The torque tool 1 comprises a wrench 4, a gripper assembly 5 rotatably mounted on the wrench 4, and at least one drive unit 6 operatively coupled between the wrench 4 and the gripper assembly 5. The torque tool 1 is particularly suitable for mounting on an arm 7(for example, a telescoping boom) mounted on a mobile platform or vehicle 8 (See FIGS. 6*a*–6*f*). This arrangement allows the torque tool 1 to be remotely maneuvered into position about a drill string so that the wrench 4 engages the wrench flats 2*a* of a drill bit 2; the gripper assembly 5 locked to the stabilizer 3; and then the gripper assembly 5 rotated to break the thread. With the torque tool 1 mounted on a mobile platform 8 in this fashion, the entire operation can be conducted remotely, without having to expose workmen to the dangers associated with manually installing and operating heavy equipment around the drill string under an open raise.

Referring to FIGS. 1–4, the wrench 4 generally comprises a C-shaped body defining a wrench opening 9 which is sized to receive and operatively engage wrench-flats 2*a* which are conventionally provided on a drill bit 2 and raise head. The wrench opening 9 is defined by a pair of opposed side walls 10, 11 which operatively engage opposed wrench flats, and a back wall 12 which serves to limit the extent to which the wrench 4 can be slid onto the drill string. In particular, the back wall 12 of the wrench opening 9 is arranged so that, when the wrench 4 is slid onto a drill string an a wrench flat 2*a* contacts the back wall 12, then the longitudinal axis of drill string will be substantially co-extensive with a centroid 13 of the wrench opening 9. In the illustrated embodiment, the wrench 4 also includes a pair of opposed guide faces 14, 15 which are oriented so as to automatically guide a drill string into the wrench opening 9 as the torque tool 1 is moved laterally toward the drill string.

Figure 3:
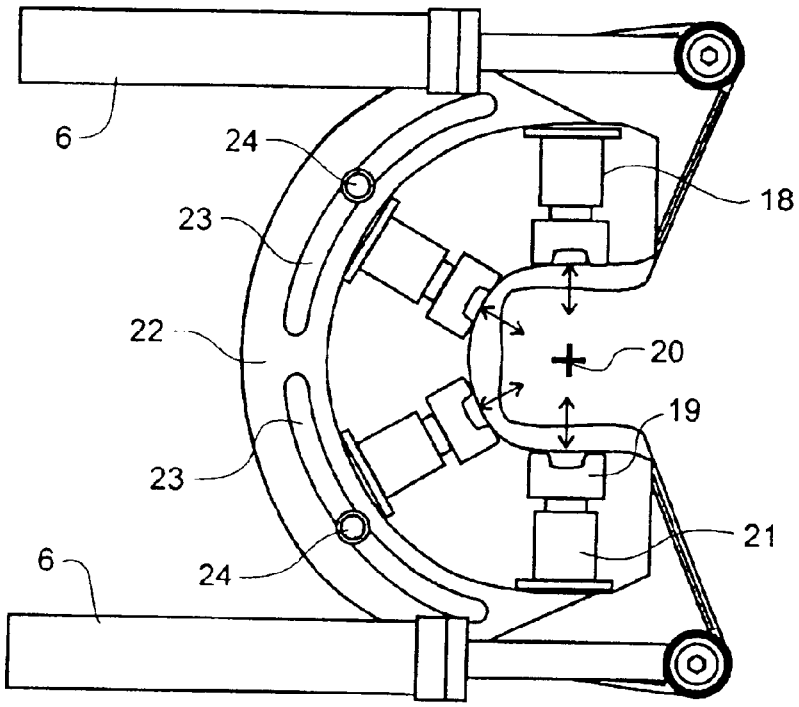
FIG. 3 is a top view showing the interior of the gripper assembly in the embodiment of FIG. 1.
Figure 4:
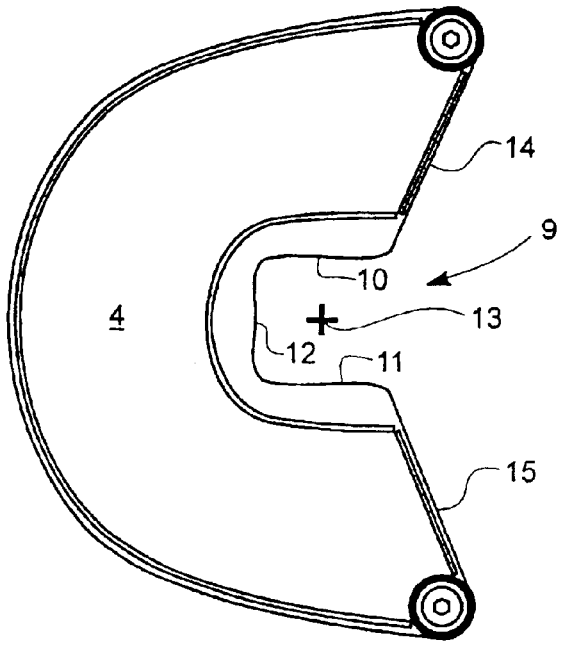
FIG. 4 is a top view of the wrench of the embodiment of FIG. 1.

The gripper assembly 5 comprises a generally C-shaped housing 16 surrounding and defining a gripper mouth 17 for receiving the stabilizer 3. At least one (four are shown in the illustrated embodiment) gripper 18 is operatively mounted within the housing 16 for releasably engaging a respective rib 3*a* of the stabilizer 3. As best shown in FIG. 3, each gripper comprises a shoe 19 mounted for substantially radial movement with respect to a centroid 20 of the gripper mouth 17. An hydraulic or pneumatic ram provides extension means 21 for forcibly moving the shoe 19 inwardly and outwardly (as shown by the arrows in FIG. 3) to respectively lock and unlock the stabilizer 3 within the gripper assembly 4.

The gripper assembly 5 is mounted on the wrench 4 for rotation about the centroid 20 of the gripper mouth 17. For this purpose, a lower plate 22 of the gripper housing 16 is provided with at least one slot 23 (two are shown in the illustrated embodiment) arranged circumferentially about the centroid 20 of the gripper mouth 17. A runner 24 is fixedly mounted on the wrench 4, and slides within the slot 23 (one runner is shown in each slot of the illustrated embodiment) so as to guide the motion of the gripper assembly 5. In use, smooth rotation of the gripper assembly 5 about the longitudinal axis of the drill string is ensured by the cooperative action of the slots 23 and runners 24, in combination with the drill string acting as a fulcrum during operation of the drive units 6.

Figure 2:
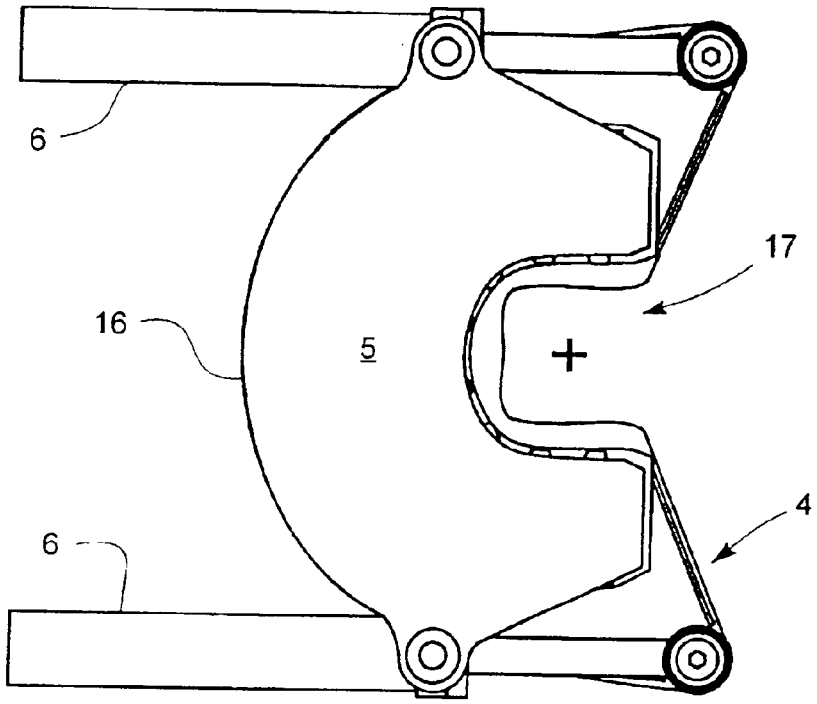
FIG. 2 is a top view of the embodiment of FIG. 1 in which the gripper assembly is shown in its neutral position.

As shown in FIGS. 2 and 3, the centroid 20 of the gripper mouth 17 is substantially co-extensive with the centroid 13 of the wrench opening 9 when the torque tool 1 is viewed from above. Thus when the torque tool 1 is maneuvered into position and slid on to the drill string so that the side and back walls 10,11,12 of the wrench opening 9 are engaging respective wrench flats 2*a* of a drill head 2, then the gripper assembly 5 will be located about the stabilizer 3. In this position, the grippers 18 can be extended to lock the stabilizer 3 to the gripper assembly 5, and subsequent rotation of the gripper assembly 5 with respect to the wrench 4 will cause rotation of the stabilizer 2 about the longitudinal axis of the drill string without inducing any undesired side-forces.

Figure 5:
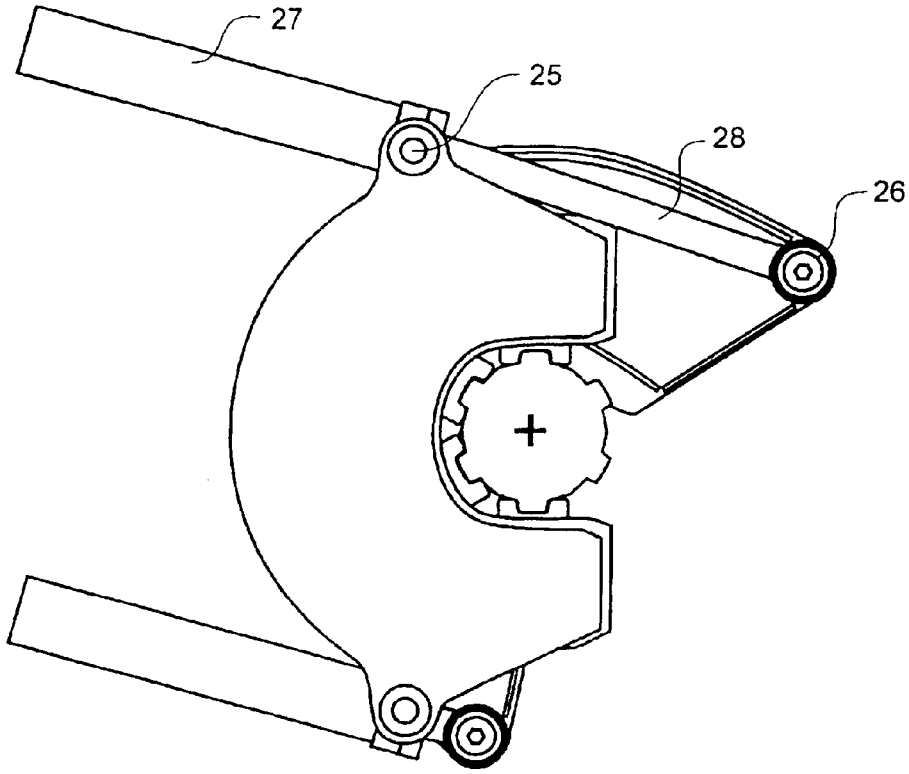
FIG. 5 is a top view of the embodiment of FIG. 1, in which the drive units have been operated to rotate the gripper assembly to an extended position with respect to the wrench.

Referring now to FIG. 5, the drive unit 6 comprises at least one, and preferably two hydraulic rams operatively coupled to the wrench 5 and the gripper assembly 4 via pivot joints 25, 26. In the illustrated embodiment, each hydraulic ram comprises a cylinder 27 pivotally connected to the gripper assembly 5 by means of a cylinder/housing pivot joint 25. A piston 28 operatively installed within the cylinder 27 is connected to the wrench 4 through a piston/wrench pivot joint 26. By this arrangement, rotation of the gripper assembly 5 can be effected by extension and/or retraction of the piston 28 within the cylinder 27.

Figure 6A:
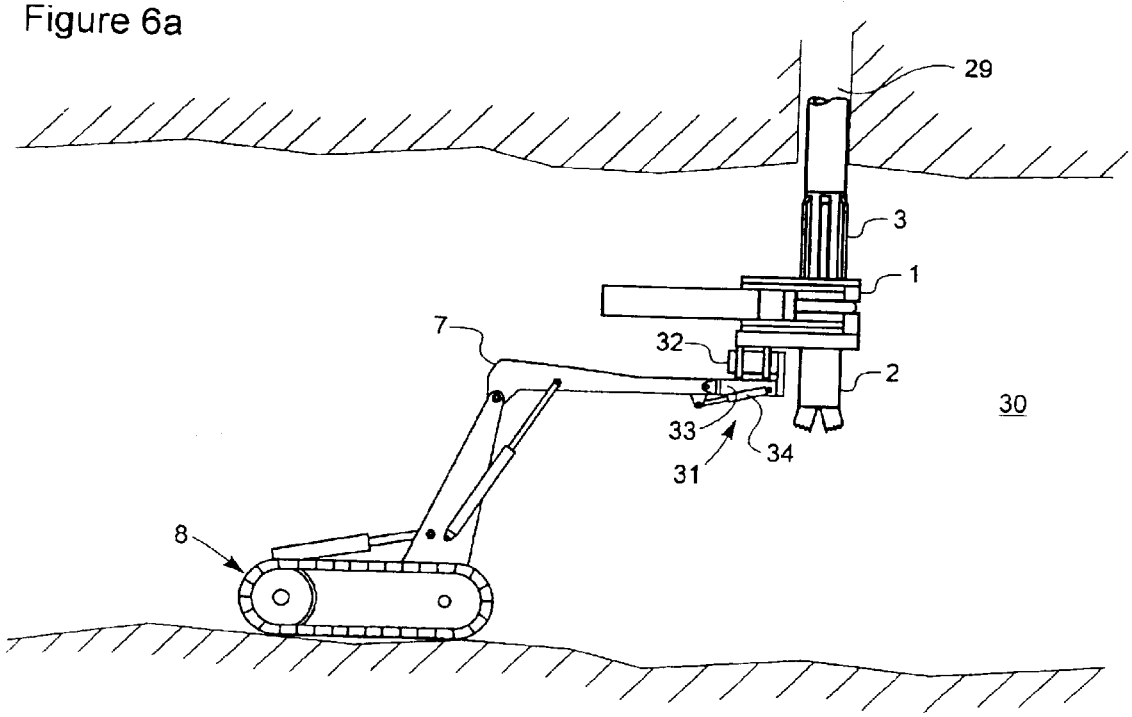
FIGS. 6*a*–6*f* are side views showing successive stages in a raise boring operation in accordance with an embodiment of the present invention.
Figure 6B:
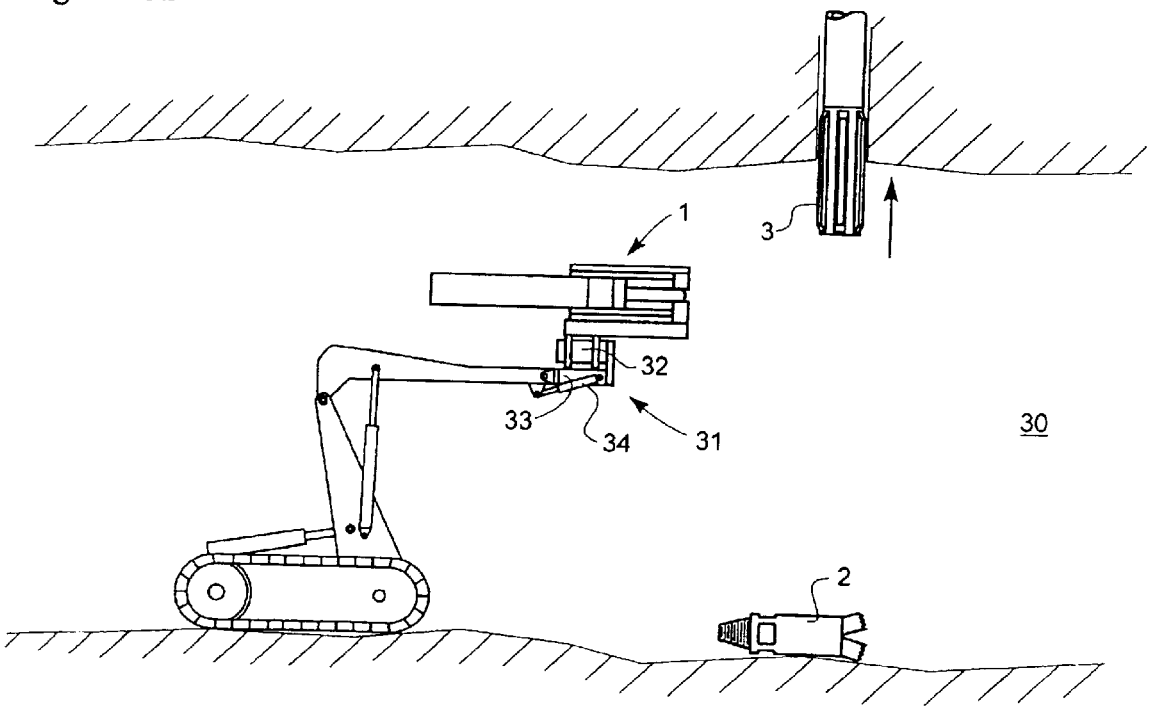

Referring now to FIG. 6*a*, in a preferred embodiment of the invention, the wrench is mounted on the end of an arm 7 mounted on a suitable mobile platform 8 such as, for example, a crawler.

A pilot hole 29 can be drilled to enter an underground drift 30 at any given angle. Typically, this angle is less than 30 degrees from vertical in two directions. Therefore the arm 7 functions must permit an operator (not shown) to orient the torque tool 1 so that the rotational axis of the gripper assembly 5 is substantially parallel to the longitudinal axis of the drill string. This means that the connection between the torque tool 1 and the arm 7 must permit a degree of rotational movement about both lateral 1 and longitudinal axes of the torque tool 1. As shown in FIGS. 6*a*–6*f*, this is achieved by means of pivot assembly 31 comprising a rotary actuator 32 to provide rotation about a longitudinal axis, and a bracket 33 controlled by an hydraulic cylinder 34 to provide tilt about a lateral axis. As shown in FIGS. 6*a*–6*f*, the torque tool 1 is mounted on the arm 7 by means of substantially rigidly mounting the wrench 4 onto the rotary actuator 32.

FIGS. 6*a*–6*f* illustrate the three stages of a raise boring operation in accordance with the present invention.

As shown in FIG. 6*a*, a pilot hole 29 is drilled using a conventional drilling rig (not shown) from an upper level (not shown) of the mine to a drift 30 on a lower level. When the drill bit 2 emerges into the lower drift 30, the torque tool 1 is used to remove the drill bit 2 from the drill string. Accordingly, an operator (not shown) controls the crawler 8 to move to a convenient working position within reach of the drill string by the arm 7. The arm 7 and pivot mechanism 31 are then operated to align the torque tool 1 with the drill string and then set the torque tool 1 into place on the drill bit 2 and stabilizer 3 (FIG. 6*a*). The grippers 18 are then actuated to lock the stabilizer 3 within the gripper assembly 5. At this point, the drive unit 6 is operated in a reverse direction to rotate the stabilizer 3 with respect to the drill bit 2 and break the threaded connection between the drill bit 2 and the stabilizer 3. The grippers 18 are then retracted, and, by communication with the drill rig operator the drill string is rotated and withdrawn slightly to completely disengage the drill bit 2 from the stabilizers. It is common practice to simply drop the bit 2 onto the ground once unthreaded (FIG. 6*b*), where it can be picked up and removed from the site by an underground loader or scoop (not shown).

Figure 6C:
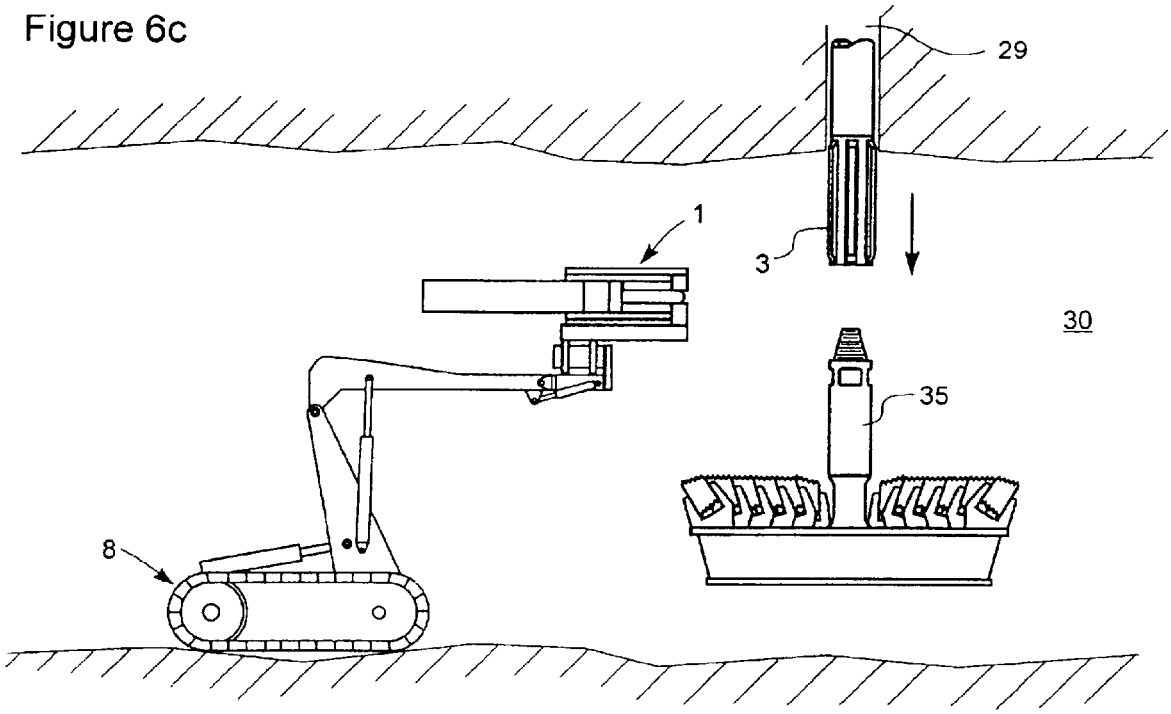

Referring now to FIG. 6*c*, the next step in the process is to bring the raise head 35 into position and mount it on the end of the drill string. Thus the raise head 35 can conveniently be secured in the bucket of the scoop (not shown for clarity) and maneuvered into position in a conventional manner. The scoop is then operated to roughly align the longitudinal axis of the raise head 35 with the longitudinal axis of the drill string which is protruding slightly out of the pilot hole 29 above, again in a conventional manner. Once aligned, by communicating with the drill rig operator on the level above, the drill string is lowered and rotated to engage the threaded connections. The conventional design of the threads allows for a degree of misalignment to exist without causing damage. Following conventional procedures, the drill rig makes up the connection until it is "hand tight".

Raise drilling requires extremely high forces transmitted from the drill rig through the drill string and into the raise head 15. To effectively break rock, extreme pressure is required between the cutters and the rock. To maintain this pressure while at the same time rotating the raise head requires that the drill rig provide very high torque inputs. This torque input is called the "working torque". The threaded connection between the raise head 35 and the stabilizer 3 is designed to withstand this torque, provided it is preloaded to approximately 20% higher than the working torque. All the connections in the drill string can be preloaded by the drill rig with the exception of the connection between the stabilizer 3 and the raise head 35. Thus the torque tool 1 is deployed for a second time to provide the necessary pre-load torque to the connection.

Figure 6D:
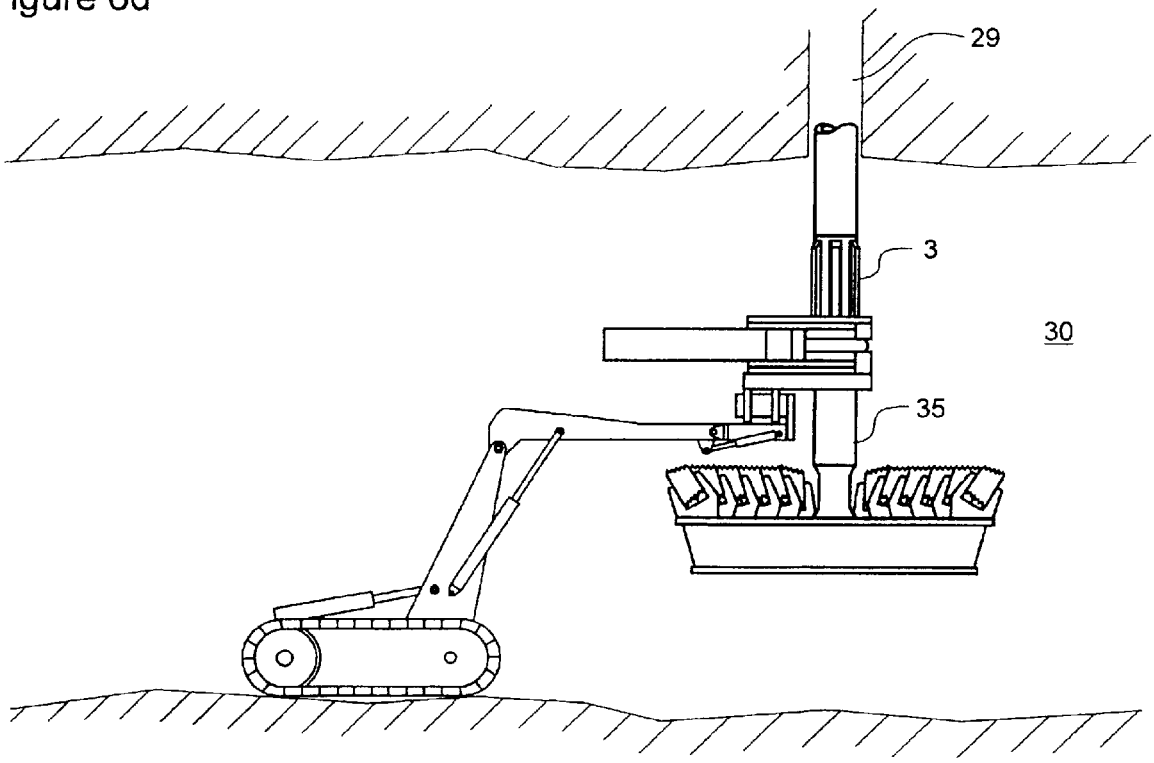

Accordingly, an operator controls the crawler 8 to move to a convenient working position within reach of the drill string by the arm 7. The arm 7 and pivot mechanism 31 are then operated to align the torque tool 1 with the drill string and then set the torque tool 1 into place on the raise head 35 and stabilizer 3 (FIG. 6*d*). The grippers 18 are then actuated to lock the stabilizer 3 within the gripper assembly 5. At this point, the drive unit 6 is operated in a forward direction to rotate the stabilizer 3 with respect to the raise head 35 and pre-load (or "make") the threaded connection between the raise head 35 and the stabilizer 3. The grippers 18 are then retracted, and, the torque tool 1 disengaged from the drill string.

Figure 6E:
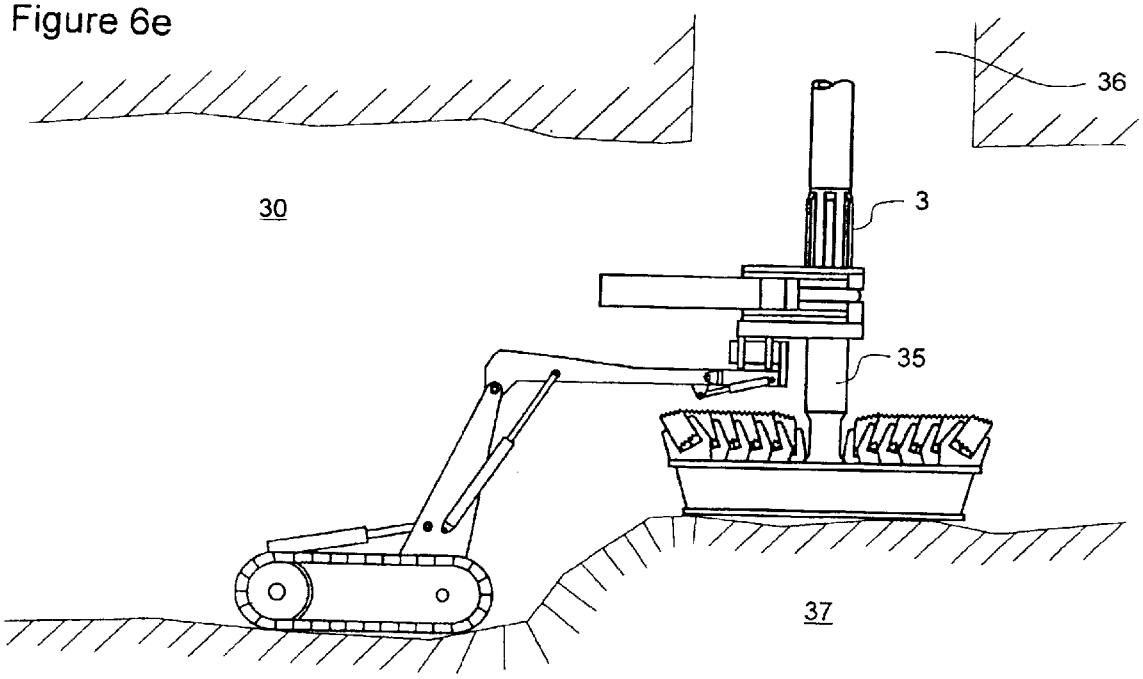
Figure 6F:
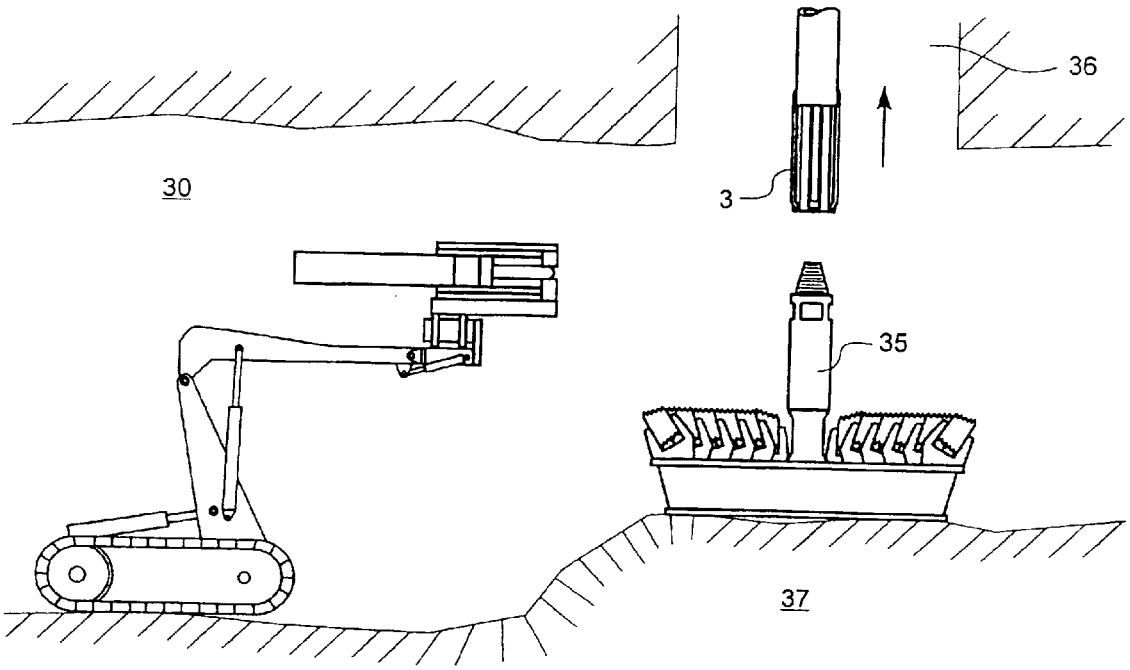

Once the raise head 35 is mounted on the drill string and preloaded as described above, reaming commences for several days, weeks, or even months until the raise 36 is completed. As cuttings 37 fall from the raise 36 they accumulate within the drift 30 and are periodically removed from the site by a scoop (not shown). Once the raise 36 has been completed, the raise head 35 is then lowered back down the raise 36 where the torque tool 1 is then deployed for the third and final time to break the threaded connection (FIGS. 6*e* and 6*f*).

Accordingly, the operator controls the crawler 8 to move to a convenient working position within reach of the drill string by the arm 7. The arm 7 and pivot mechanism 31 are then operated to align the torque tool 1 with the drill string and then set the torque tool 1 into place on the raise head 35 and stabilizer 3 (FIG. 6*e*). The grippers 18 are then actuated to lock the stabilizer 3 within the gripper assembly 5. At this point, the drive unit 6 is operated in a reverse direction to rotate the stabilizer 3 with respect to the raise head 35 and break the threaded connection between the raise head 35 and the stabilizer 3. The grippers 18 are then retracted, and, by communication with the drill rig operator the drill string is rotated and withdrawn slightly to completely disengage the raise head 35 from the stabilizer 3.

At this stage, the torque tool 1 can be disengaged from the raise head 35, and the crawler 8 withdrawn and moved to a new site. The drill rig is then operated to raise and disassemble the drill string for future use. Finally, a scoop is again brought in, this time to remove the raise head 35 from the site and move it to the next location.

Throughout this final stage of the operation, neither the operator of the crawler 8/torque tool 1, or the scoop are required to be directly under the open raise 36. Accordingly, nether of these workers are exposed to the dangers of falling debris.

It will be apparent that the present invention can be varied without departing from the intended scope of the appended claims. For example, the present invention is illustrated by way of an embodiment in which the torque tool 1 is mounted on the arm 7 of a crawler 8. However, the torque tool 8 could equally be utilized mounted on an arm or boom of any suitable vehicle capable of service in underground mining operations. Similarly, in the illustrated embodiment, alignment of the torque tool 1 with the drill string is accomplished by means of a pivot mechanism 31 which comprises an hydraulic rotary actuator 32 mounted on a pivoting bracket 33. However, the skilled artisan will recognize that any suitable two-axis pivoting system can be used to accomplish the same results. Thus it will be understood that the specific embodiment described above is intended to be illustrative rather than limitative of the present invention.

What is claimed is:

1. An apparatus for making and breaking a threaded connection between a drill head and a stabilizer mounted on an end of a drill string, the apparatus comprising:

a wrench capable of operatively engaging a portion of the drill head by movement in a lateral direction with respect to the drill string, so as to substantially prevent rotation of the drill head with respect to the wrench;

a gripper operatively mounted on the wrench, the gripper assembly being capable of operatively receiving a portion of the stabilizer by movement in a lateral direction with respect to the drill string, and for releasably locking the stabilizer against rotation relative to the gripper assembly;

at least one drive unit operatively coupled between the wrench and the gripper assembly driving rotational movement of the gripper assembly with respect to the wrench between a neutral position and a selected one of a first and a second extended positions.

2. An apparatus as defined in claim 1, wherein, when the gripper assembly is in the neutral position, the wrench can be operatively engaged with the drill head, and the gripper assembly simultaneously operatively engaged with the stabilizer, by lateral movement of the entire assembly with respect to the drill string.

3. An apparatus as defined in claim 1, wherein the wrench comprises a generally C-shaped body defining an open-ended wrench opening capable of operatively receiving a portion of the drill head.

4. An apparatus as defined in claim 3, wherein the wrench opening comprises a pair of opposed side walls capable of receiving a portion of a drill head therebetween so as to operatively engage respective opposed wrench-flats of the drill head, whereby rotation of the drill head with respect to the wrench is substantially prevented.

5. An apparatus as defined in claim 4, wherein the wrench opening includes a back wall capable of engaging a respective wrench flat of the drill head, such that a central axis of the drill string is substantially coextensive with a centroid of the wrench opening.

6. An apparatus as defined in claim 3, wherein the wrench comprises a pair of opposed guide faces oriented so as to automatically guide a drill string into the mouth of the gripper assembly and wrench opening as the assembly is moved toward the drill string.

7. An apparatus as claimed in claim 1, wherein the gripper assembly comprises a generally C-shaped housing defining an open-ended gripper mouth for receiving the stabilizer; and at least one gripper operatively mounted within the housing for releasably engaging a respective rib of the stabilizer.

8. An apparatus as defined in claim 7, wherein the gripper comprises a shoe mounted for substantially radial movement with respect to a longitudinal axis of a stabilizer disposed within the gripper mouth, and extension means for forcibly moving the shoe inwardly and outwardly to respectively lock and unlock the stabilizer against rotation relative to the gripper assembly.

9. An apparatus as defined in claim 7, wherein a centroid of the gripper assembly is substantially coextensive with the centroid of the wrench opening when the apparatus is viewed from above.

10. An apparatus as defined in claim 9, wherein the gripper assembly is mounted on the wrench for rotation about the centroid of the gripper mouth.

11. An apparatus as defined in claim 8, wherein the extension means is any one of an hydraulic ram and a pneumatic ram.

12. An apparatus as defined in claim 8, wherein there are 4 grippers substantially evenly separated for each other within the housing of the gripper assembly, the grippers acting cooperatively to releasably lock and unlock the stabilizer against rotation relative to the gripper assembly.

13. An apparatus as defined in claim 1, wherein the drive unit comprises at least one hydraulic ram operatively coupled to the wrench and the gripper assembly, such that rotation of the gripper assembly with respect to the wrench can be effected by extension and/or retraction of the hydraulic ram.

14. An apparatus as defined in claim 1, wherein the drive unit comprises at least one pneumatic ram operatively coupled to the wrench and the gripper assembly, such that rotation of the gripper assembly with respect to the wrench can be effected by extension and/or retraction of the pneumatic ram.

15. An apparatus for making and breaking a threaded connection between a drill head and a stabilizer mounted on an end of a drill string, the apparatus comprising:

support means capable of being maneuvered to a convenient location proximal an exposed drill head and stabilizer of a drill string;

an arm operatively mounted on the support means; and a torque tool mounted on a free end of the arm, the torque tool comprising:

a wrench operatively mounted on a free end of the arm, the wrench being capable of operatively engaging a portion of the drill head by lateral movement with respect to the drill string, so as to substantially prevent rotation of the drill head with respect to the wrench;

a gripper operatively mounted on the wrench, the gripper assembly being capable of operatively receiving a portion of the stabilizer by lateral movement with respect to the drill string, and for releasably locking the stabilizer against rotation relative to the gripper assembly;

at least one drive unit operatively coupled between the wrench and the gripper assembly, for driving rotational movement of the gripper assembly with respect to the wrench between a neutral position and a selected one of a first and a second extended positions.

16. An apparatus as defined in claim 15, wherein the support means is a vehicle capable of operating in an underground mine.

17. An apparatus as defined in claim 16, wherein the support means is a crawler.

18. An apparatus as defined in claim 15, further comprising a pivot mechanism operatively coupled between the arm and the torque tool, the pivot mechanism being capable of rotating the torque tool about at least two orthogonal axes, whereby a rotational axis of the gripper assembly with respect to the wrench can be substantially aligned with the drill string.

* * * * *